US009376774B2

(12) United States Patent
Menzenbach et al.

(10) Patent No.: US 9,376,774 B2
(45) Date of Patent: Jun. 28, 2016

(54) DEVICE, AS WELL AS METHOD FOR WORKING GROUND SURFACES OR ROADWAYS

(71) Applicant: Wirtgen GmbH, Windhagen (DE)

(72) Inventors: Christoph Menzenbach, Neustadt/Wied (DE); Bernd Walterscheid, Hennef (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/505,660

(22) Filed: Oct. 3, 2014

(65) Prior Publication Data

US 2015/0098760 A1 Apr. 9, 2015

(30) Foreign Application Priority Data

Oct. 7, 2013 (DE) ..... 10 2013 016 515

(51) Int. Cl.

| | |
|---|---|
| ***E01C 23/00*** | (2006.01) |
| ***E01C 19/17*** | (2006.01) |
| ***B05B 1/30*** | (2006.01) |
| ***B05B 12/12*** | (2006.01) |

(Continued)

(52) U.S. Cl.

CPC ..... *E01C 19/176* (2013.01); *B05B 1/3046* (2013.01); *B05B 12/124* (2013.01);

(Continued)

(58) Field of Classification Search

CPC .. B05B 1/3046; B05B 12/124; B05B 13/005; B05B 15/0233; E01C 19/176; E01C 21/00; E01C 23/00; E01C 23/065; E01C 23/088

USPC ..... 404/83, 90–93

See application file for complete search history.

(56) References Cited

U.S. PATENT DOCUMENTS

| | | | |
|---|---|---|---|
| 5,294,210 | A | 3/1994 | Lemelson |
| 5,707,010 | A | 1/1998 | Manfre et al. |

(Continued)

FOREIGN PATENT DOCUMENTS

| | | | |
|---|---|---|---|
| EP | 0960239 | B1 | 2/2002 |
| EP | 1396581 | A2 | 3/2004 |

(Continued)

OTHER PUBLICATIONS

European Search Report in corresponding European Patent Application No. EP 14 18 7128 dated Mar. 2, 2015, 3 pp. (not prior art).

*Primary Examiner* — Raymond W Addie

(74) *Attorney, Agent, or Firm* — Lucian Wayne Beavers; Patterson Intellectual Property Law PC

(57) ABSTRACT

In a device for working ground surfaces or roadways including a machine frame and a working drum in a drum housing arranged at said machine frame, where no less than one spraying device extending parallel to the working drum and featuring several outlet nozzles for spraying agents arranged next to one another and directed towards the working drum is arranged at the drum housing, where the outlet nozzles include one each drivable closing mechanism with a closing element which, in an open position, fully uncovers the nozzle channel of the outlet nozzle and, in a closed position, closes the nozzle channel, it is provided for the following features to be achieved: that a controller drives the closing mechanisms, with the outlet nozzles and the related closing elements being adapted to one another in such a fashion that the flow cross-section in the outlet nozzle is variable in accordance with the position of the closing element on a specified path between the open position and closed position.

42 Claims, 5 Drawing Sheets

(51) Int. Cl.

| | |
|---|---|
| ***B05B 13/00*** | (2006.01) |
| ***B05B 15/02*** | (2006.01) |
| ***E01C 23/06*** | (2006.01) |
| ***E01C 21/00*** | (2006.01) |
| ***E01C 23/088*** | (2006.01) |

(52) U.S. Cl.

CPC ..... *B05B13/005* (2013.01); *B05B 15/0233* (2013.01); *E01C 21/00* (2013.01); *E01C 23/00* (2013.01); *E01C 23/065* (2013.01); *E01C 23/088* (2013.01)

(56) References Cited

U.S. PATENT DOCUMENTS

| | | | | |
|---|---|---|---|---|
| 5,827,360 | A * | 10/1998 | Salminen | B29C 44/3446 106/273.1 |
| 5,893,677 | A | 4/1999 | Haehn et al. | |
| 6,565,281 | B2 | 5/2003 | Bruns et al. | |
| 6,887,013 | B2 | 5/2005 | Ley et al. | |
| 8,899,501 | B2 * | 12/2014 | Fox et al. | 239/600 |
| 9,089,869 | B2 * | 7/2015 | Galvin | B05C 5/0279 |
| 9,108,214 | B2 * | 8/2015 | Riney | B05B 15/0233 |
| 2001/0022919 | A1 * | 9/2001 | Bruns et al. | 404/91 |
| 2002/0192025 | A1 * | 12/2002 | Johnson | E01C 23/088 404/75 |
| 2008/0193299 | A1 * | 8/2008 | Oglesby | 417/53 |
| 2014/0353394 | A1 * | 12/2014 | Foster et al. | 239/1 |

FOREIGN PATENT DOCUMENTS

| | | | | |
|---|---|---|---|---|
| GB | 2279022 | * | 6/1993 | B05B 15/02 |
| WO | 9624725 | A1 | 8/1996 | |

* cited by examiner

DEVICE, AS WELL AS METHOD FOR WORKING GROUND SURFACES OR ROADWAYS

BACKGROUND OF THE INVENTION

1. Field of the Invention

The invention relates to a device, as well as a method for working ground surfaces or roadways.

2. Description of the Prior Art

The prior art includes, for example, EP 960 239 B1 (U.S. Pat. No. 6,565,281) or EP 1 396 581 A2 (U.S. Pat. No. 6,887,013).

The known devices for working ground surfaces or roadways, such as soil stabilizers or recyclers, are provided with a working drum which breaks up and mixes ground surfaces or roadways. In the case of hard roadways consisting of asphalt or concrete, these are milled. The working drum is surrounded by a bell-shaped drum housing which encloses the working chamber of the working drum, where said working chamber serves as a mixing chamber for mixing the worked-off ground material with a spraying agent, such as hydraulic or bituminous binding agents (foamed bitumen, emulsions, or slurries), or water. Alternatively, binding agents (such as cement or lime) may also be discharged/spread on the ground surface in front of the soil stabilizer/recycler.

In other ground working machines, such as road milling machines or surface miners, a spraying device may be provided to cool the cutting tools.

The spraying agents are sprayed into the working chamber by means of a spraying device attached at the drum housing, with several outlet nozzles of the spraying device being arranged at the drum housing and directed into the working chamber.

With the known spraying devices, the problem arises that the spraying agent can be introduced into the working chamber in a non-uniform fashion over the working width of the working drum, in particular in those cases requiring only a small volume of spraying agent and/or the working drum with the spraying device exhibits a transverse slope vis-à-vis the horizontal plane. In case of a transverse slope, a pressure gradient results along the spraying device so that a different flow rate issues at the individual outlet nozzles.

The known outlet nozzles can merely be switched on or switched off via a tappet-like closing element or can perform a cleaning function by means of the closing element. The cleaning function is useful because, even at a high spraying pressure, the worked-off material mixed with binding agents or water can get pressed into the outlet nozzles or can accumulate in the area in front of the outlet nozzle. Especially after a machine stoppage, there is the risk of the outlet nozzles being contaminated and blocked by set or hardened or dried worked-off material from the working chamber which will result in a decrease or even a complete inhibition of the spraying performance.

Consideration has been given to influencing the flow rate at the outlet nozzles by means of ball valves, throttle slide valves or iris diaphragms in order to ensure a uniform discharge of binding agents and/or water. However, a sufficient reliability of these systems is not given due to their sensitivity to thermal expansion and encrustation of the moving parts by, for example, solidified bitumen. In addition, problems are caused by the increased space requirement, and difficulties arise with the accompanying drive mechanisms, as well as due to the complicated automation of said proposed solutions.

SUMMARY OF THE INVENTION

It is therefore the object of the invention to improve a device and a method for working ground surfaces and roadways by means of outlet nozzles of a spraying device directed into the working chamber to the effect that, via a selectable working width, a uniform discharge of a spraying agent is made possible also for different volumetric flow rates, different spraying agents and different transverse slopes of the device.

The invention advantageously provides for a controller to drive the closing mechanisms, with the outlet nozzles and the related closing elements being adapted to one another in such a fashion that the flow cross-section in the outlet nozzle is variable in accordance with the position of the closing element on a specified path between the open position and closed position. The proposed solution offers the advantage of enabling the current flow cross-section to be altered in accordance with the position of the closing element without requiring additional elements solely by the mutual adaptation and design of the geometry of the closing element and/or the outlet nozzle. The variable adjustment of the closing elements offers the advantage of the pressure at the individual outlet nozzles being maintained in the case of low flow rates. A special advantage of the variable flow cross-section when using binding agents is that, due to the design of the outlet nozzles and/or the closing element, the outlet nozzles cannot clog up with binding agents and impair the function of the closing element.

In this arrangement, all outlet nozzles may be individually drivable and also controllable either separately or jointly.

The cleaning function known from prior art according to EP1 396 581 A2 (U.S. Pat. No. 6,887,013) and the possibility to selectively switch off specific outlet nozzles are maintained. Further advantages are that the solution does not generate increased space requirements, complies with high requirements in terms of metering accuracy and can, for example, be used for a wide range of flow rates between nearly 0 to up to 1000 l/min. The solution can be used both for spraying devices for foamed bitumen as well as for water, emulsions and slurries. Finally, the solution offers the advantage of being insensitive to temperature fluctuations, with the range of use extending to up to 200° C.

It is preferably intended for the controller to position the closing elements of the individual outlet nozzles in either identical or individually different intermediate positions. The controller can thus equalize different pressure conditions at the individual outlet nozzles automatically or can selectively switch off specific outlet nozzles.

In this arrangement, control of the nozzles may, for example, be performed in accordance with the volumetric flow, or in accordance with the pressure in the spraying device, or in accordance with the transverse slope.

The part of the closing element interacting with the outlet nozzle and/or the outlet nozzle may, in the direction of an increasing positioning movement of the closing element towards the closed position, form a decreasing flow cross-section between the closing element and the outlet nozzle. The flow rate is thus controlled solely by the interaction between the position of the closing element and the geometry of the outlet nozzle and/or the closing element.

The closing element is preferably movable and positionable coaxially to the nozzle channel of the outlet nozzle.

The closing element may, for example, be drivable by means of a piston rod of a driving device coupled with a displacement measuring device, such as a piston-cylinder unit or a linear motor, an electric motor, a spindle drive or similar, the measured displacement signal of which can be supplied to the controller in order to control the current position of the closing element via an actuation signal for the piston-cylinder unit.

In a preferred embodiment, the outlet nozzle may feature a nozzle geometry which, in accordance with the position of the closing element, with an increasing positioning movement of the closing element between the open position, in which the nozzle cross-section is fully uncovered, and the closed position, in which the nozzle cross-section is fully closed, creates a decreasing flow cross-section between the closing element and the outlet nozzle by means of an intermediate position of the closing element.

To this end, the nozzle channel of the outlet nozzle may, on the inlet side, comprise a first section extending up to the closed position of the closing element, the nozzle cross-section of which narrows preferably conically in the direction of flow of the outlet nozzle.

As an alternative, the outlet nozzle may, on the inlet side, comprise a first section extending up to the closed position of the closing element, the outer wall of which features no less than one cut-out suitable for the application of a binding agent.

The width of the cut-out may change, and preferably reduce, in closing direction of the closing element.

The closing element, which preferably exhibits a constant nozzle cross-section at the end facing the outlet nozzle, may alternatively feature a first section tapering preferably conically or in a stepped fashion, said first section being followed by a second section adapted to the nozzle cross-section.

The controller can control or regulate the flow cross-section of all outlet nozzles or of each individual outlet nozzle in accordance with the currently specified flow rate and/or the currently used spraying agent and/or the transverse slope of the spraying device and/or the pressure in the spray bar.

In the method according to the invention for working ground surfaces or roadways with a device comprising a working drum and no less than one spraying device extending parallel to the working drum and featuring several outlet nozzles for spraying agents, such as binding agents, water, emulsions, slurries or foamed bitumen, arranged next to one another and directed towards the working drum, where the nozzle channel of the outlet nozzles is uncovered in an open position when working the ground surfaces or roadways, and is closed in a closed position at the termination of the working operation or for adjustment to an active width of the working drum, it is provided for the closing mechanisms of the outlet nozzles to be drivable during the working operation, where the closing elements of the individual outlet nozzles, between the open position and the closed position, are positioned in identical or different intermediate positions and where the closing elements interact with the respective nozzle cross-sections in the respective intermediate positions in such a fashion that a variably selectable flow cross-section for the outlet nozzles is adjusted in accordance with the position of the closing elements.

In this arrangement, the flow cross-section of each individual outlet nozzle or of several outlet nozzles can be controlled or regulated in accordance with the currently specified flow rate and/or the currently used spraying agent and/or the transverse slope of the spraying device and/or the pressure in the spraying device.

A variable flow cross-section between the closing element and the outlet nozzle can be generated by the interaction of the geometry of the outlet nozzle with the position of the closing element.

The controller can trigger an additional movement of the closing element beyond the closed position which enables material accumulations in and/or in front of the outlet nozzle to be removed.

It may specifically be intended for the outlet nozzle to be arranged at a conduit or at an injection chamber, in which arrangement the hydraulic or bituminous binding agent or water can be supplied transverse to the outlet nozzle. The closing element traverses the conduit or the injection chamber for the purpose of closing or cleaning the outlet nozzle and is guided coaxially to the outlet nozzle.

BRIEF DESCRIPTION OF THE DRAWINGS

In the following, embodiments of the invention are explained in more detail with reference to the drawings.

The following is shown.

DETAILED DESCRIPTION

Figure 1:
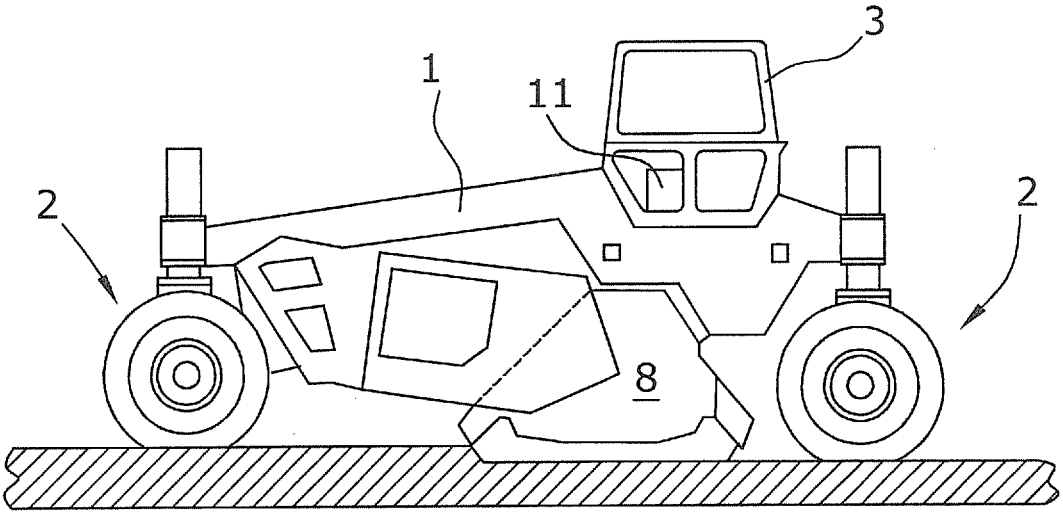
FIG. 1 shows a road construction machine.
Figure 2:
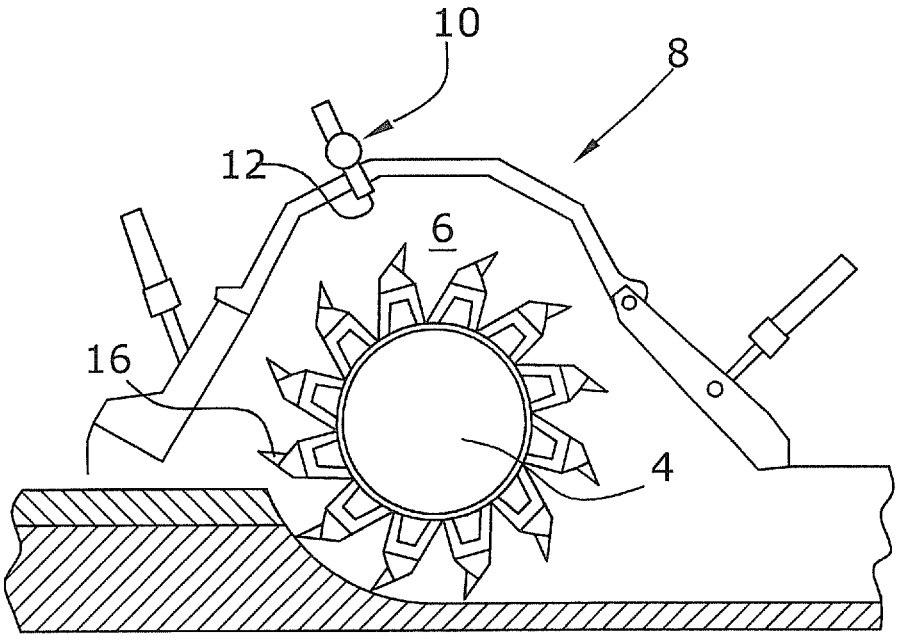
FIG. 2 shows the working chamber of a working drum underneath a drum housing with injection device.

FIG. 1 shows an automotive device for working roadways, in particular a cold recycler or a soil stabilizer, with a machine frame 1 carried by wheels 2 and an operator's platform comprised of a driver's cabin 3. The wheels 2 may be driven individually and may alternatively also be replaced by crawler tracks.

A working drum 4 is arranged underneath the machine frame 1 in a drum housing 8 which forms the boundary of the working chamber 6 of the working drum 4 towards the top and to the sides. A detailed description of the road construction machine shown in FIG. 1 can be inferred from WO-A96/24725 (U.S. Pat. No. 5,893,677), the details of which are incorporated herein by reference.

The drum housing 8 features a spraying device 10 in its upper section which can be used to inject, by means of several outlet nozzles 12 arranged preferably next to one another, for example, binding agents or water into the working chamber 6 and onto the working drum 4.

The binding agent can include hydraulic or bituminous binding agents and, in case of mixtures of hydraulic binding agents and water, of slurries, such as water-cement slurry, or, in case of mixtures of bituminous binding agents and water, of emulsions. Furthermore, foamed bitumen can be injected via the outlet nozzles 12 where, for the production of foamed bitumen, heated, liquid bitumen is mixed with cold water. This causes the bitumen to foam, the original volume of the components increasing by about 20 times.

The spraying device 10 obtains the binding agent or water via a conduit 14 which may be a loop conduit. The binding agent or water runs transverse to the outlet nozzle 12. The outlet nozzle 12 attached to the conduit 14 is directed into the working chamber 6 and is arranged in a cut-out of the drum housing 8 adapted to the outlet nozzle 12. The tools 16 of the working drum have a cutting circle which may exhibit a relatively small distance to the drum housing 8 of, for example, approx. 50 mm. For each outlet nozzle 12, a closing mechanism 18 is intended which is comprised of a piston-cylinder unit 20, the piston rod of which forms or drives a closing element 22 for the outlet nozzle 12. The closing mechanism 18 drivable, for example, by a controller is variably adjustable. In an open position of the closing element 22 (FIG. 3*a*), the outlet nozzle is fully uncovered. In the closed position (FIG. 3*b*), the outlet nozzle 12 is closed so that no binding agent or water can exit at said outlet nozzle 12. In addition, no material 24 worked off and mixed with binding agents or water can penetrate the nozzle channel 26 of the outlet nozzle 12 from the working chamber 6. Between the open position and the closed position, the controller can adjust any intermediate positions in order to variably adapt the flow cross-section through the outlet nozzle to the current working conditions. In a special function, the closing element 22 can further be transferred into a cleaning position beyond the closed position.

The tip of the closing element 22 facing the working chamber 6 terminates at the end of the nozzle channel 26 facing the working chamber 6 and is preferably recessed vis-à-vis the shell surface 9 of the drum housing 8 facing the working chamber 6 in order to avoid damage to the closing element 22 during the working operation.

Figure 4A:
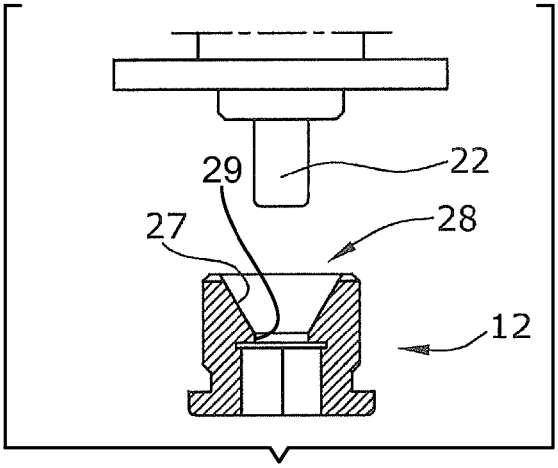
FIG. 4*a* shows one embodiment of an outlet nozzle with an initially conical nozzle channel.
Figure 4B:
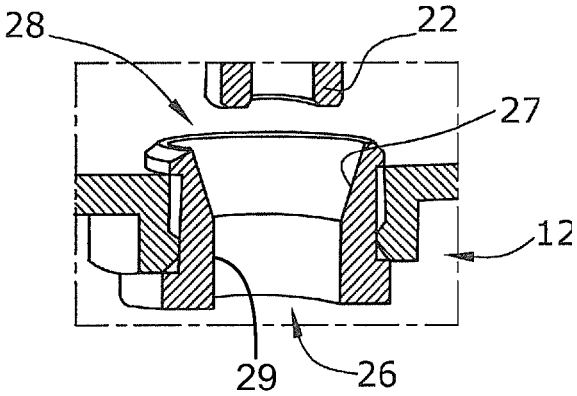
FIG. 4*b* shows another embodiment of an outlet nozzle with an initially conical nozzle channel.

FIGS. 4*a* and 4*b* show an embodiment of an outlet nozzle 12 at its nozzle inlet opening 28 comprising a first section 27 which narrows conically in the direction of flow, as well as a second section 29 following in the direction of flow which comprises a nozzle channel 26 with a constant cross-section.

Depending on the position of the cylindrical closing element 22, a different flow cross-section results as a function of the variable position of the closing element 22 when the closing element 22 is in the area of the outlet nozzle 12.

It is understood that, in variation of the embodiment in FIGS. 4*a* and 4*b*, a different narrowing cross-sectional shape of the first section 27 is also possible in which the nozzle cross-section of the nozzle channel does not narrow continuously.

Figure 5A:
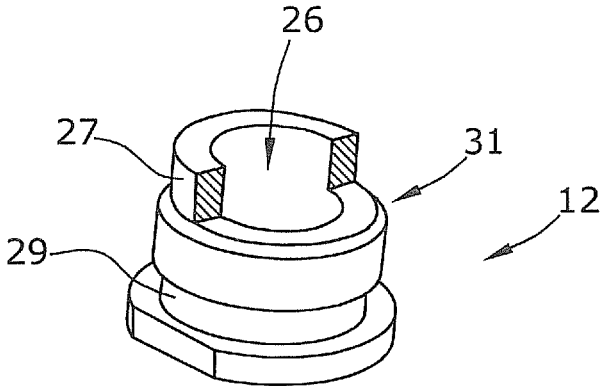
FIG. 5*a* shows one embodiment of an outlet nozzle with a nozzle channel featuring a constant cross-section.
Figure 5B:
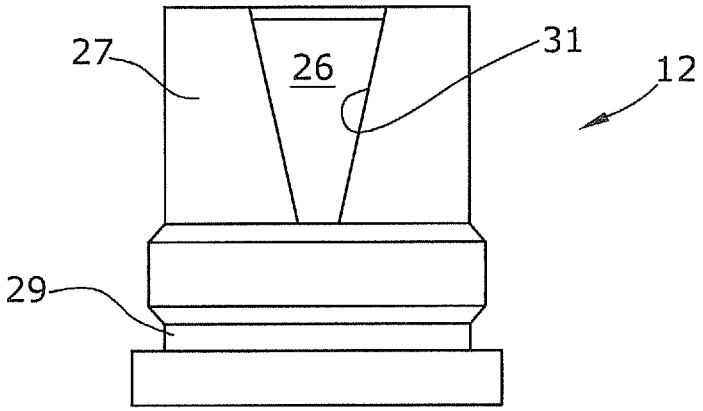
FIG. 5*b* shows a second embodiment of an outlet nozzle with a nozzle channel featuring a constant cross-section.
Figure 5C:
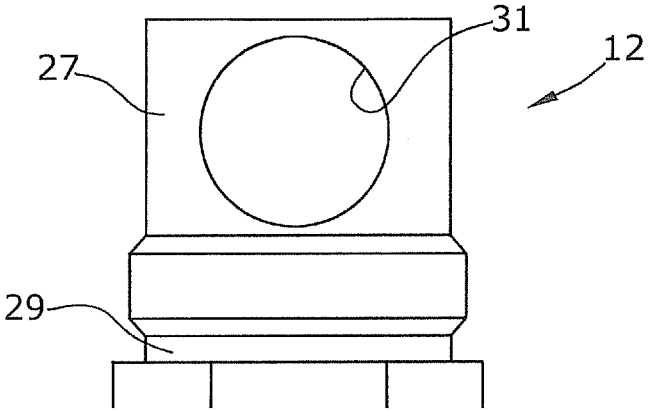
FIG. 5*c* shows a third embodiment of an outlet nozzle with a nozzle channel featuring a constant cross-section.

FIGS. 5*a* to 5*c* show another embodiment of the outlet nozzle 22 in which the nozzle channel 26 preferably features a non-alterable cross-section and is additionally preferably cylindrical in shape.

In general, the embodiments shown in FIGS. 5*a* to 5*c* relate to an embodiment in which the first section 27 of the outlet nozzle 12 comprises no less than one cut-out 31 which may be of different designs.

In the embodiment shown in FIG. 5*a*, the first section 27 comprises a wall with a basically cylindrically hollow cross-section, where the cut-out 31, in the embodiment of FIG. 5*a*, forms approx. one half of a hollow cylinder. It is understood that the cut-out 31 may also have a smaller or larger circumference or that several cut-outs 31 may also be arranged in the basically cylindrically hollow first section 27.

The embodiment of FIG. 5*b* shows a first section 27 of the outlet nozzle 12 in which the cut-out 31 tapers in the direction of flow of the outlet nozzle 12. In this embodiment, it is also possible for several such V-shaped cut-outs 31 to be distributed on the circumference of the first section.

In the embodiment of FIG. 5*c*, the first section 27 of the outlet nozzle 12 has an initially basically cylindrically hollow shape, in which arrangement one or several cylindrical cut-outs 31 may be arranged in the hollow cylinder forming the section 27.

Finally, cut-outs of different designs may also be intended for all embodiments of FIGS. 4*a* to 5*c*.

It is understood that the first section 27 of the outlet nozzle 12 is mounted in such a fashion that the cut-outs are pressurized, from the outside, with the fluid pressure of the spraying agent.

In principle, there is also the possibility to combine the design of the first section 27 according to FIG. 4*a* or 4*b* with the design of the embodiments shown in FIGS. 5*a* to 5*c*.

In all embodiments, the nozzle cross-section can therefore be varied in accordance with the position of the closing element 22.

Figure 6:
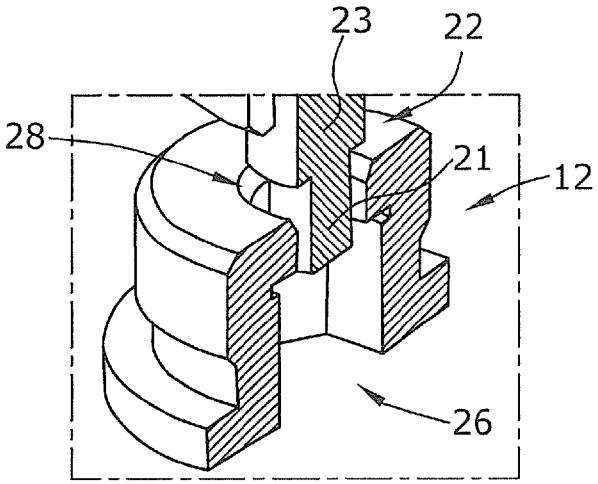
FIG. 6 shows a closing element with altered tip geometry.

FIG. 6 shows an embodiment of an outlet nozzle 12 in which the closing element 22 comprises a first section 21 facing the outlet nozzle 12, said first section 21 exhibiting a smaller cross-sectional area than the cross-sectional area of the nozzle channel 26 while the second section 23, which follows behind the first section 21 as seen in the direction of flow of the outlet nozzle 12, is precisely adapted to the cross-section of the nozzle channel 26 in order to be able to close the nozzle channel 26.

The section 21 may also feature a continuously changing cross-sectional area, for example, a conically tapering tip of the closing element 22.

In this design, the closing element 22 may also be driven, in an intermediate position between the open position and the closed position, by the controller 11 in such a fashion that a changed nozzle cross-section is adjustable.

The embodiment of FIG. 6 with a closing element 22 tapering towards the tip is also combinable with the embodiments of FIGS. 4*a*-4*b* and 5*a*-5*c*.

All embodiments shown in FIGS. 4*a* to 6 have in common that the controller 11 can drive the closing elements 22 in such a fashion that the flow cross-section in the outlet nozzle 12 is variable in accordance with the position of the closing element 22.

In this arrangement, several outlet nozzles can be driven by the controller in the same way or individually.

Figure 3C:
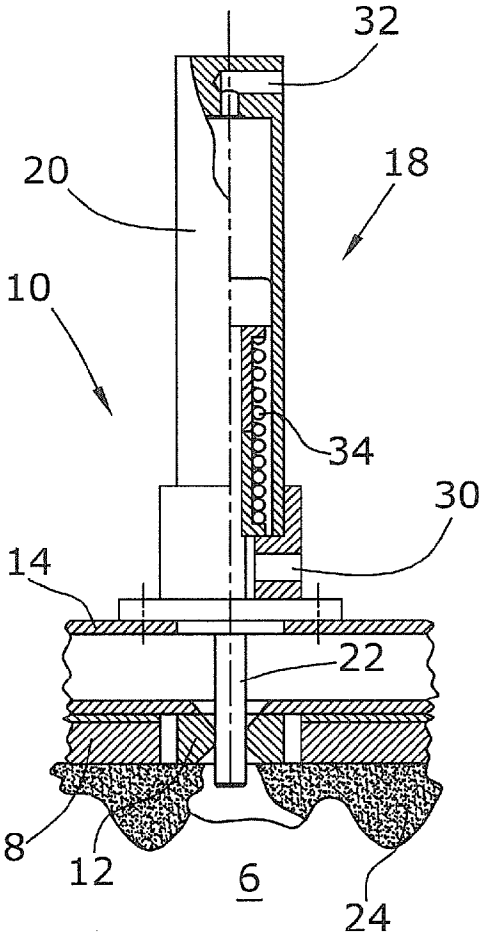
FIG. 3*c* shows a further extended position of the closing element.
Figure 3B:
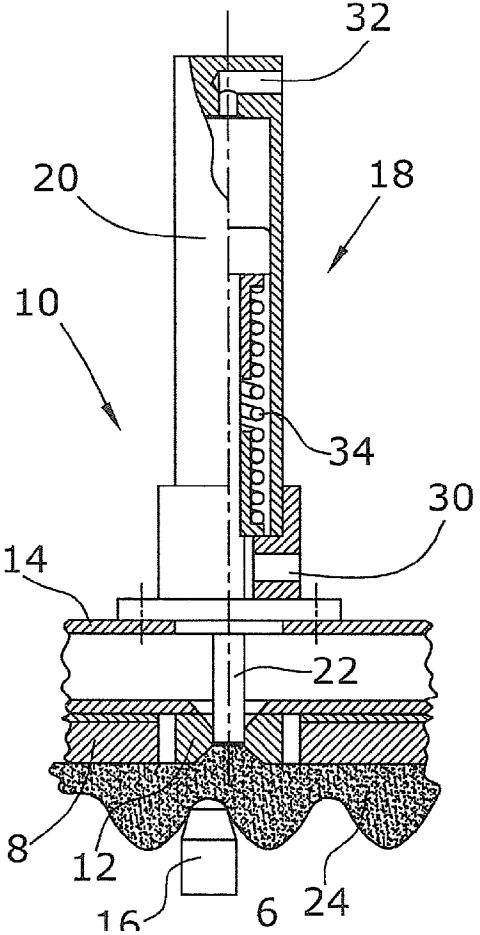
FIG. 3*b* shows a closed position of the closing element.
Figure 3A:
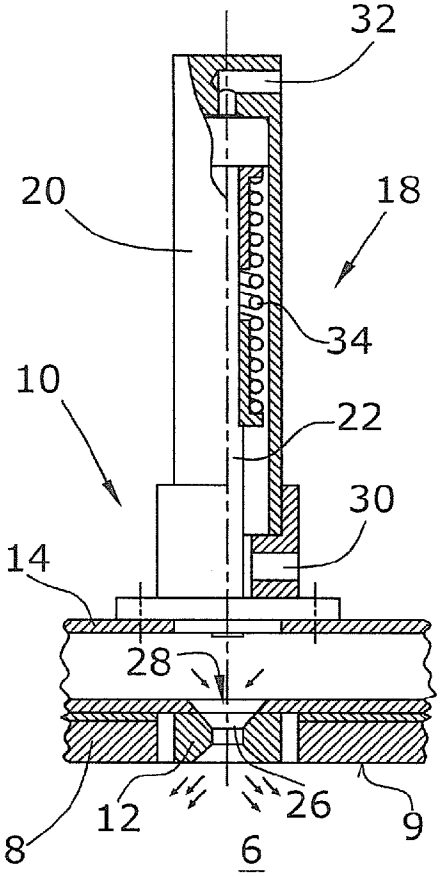
FIG. 3*a* shows an open position of the closing element.

In a further switching position shown in FIG. 3*c* in which the closing element 22 is moved, via an additional stroke movement of the closing element 22, beyond the closed position, the closing element 22 can remove material accumulations of the worked-off material 24 in and/or in front of the outlet nozzle 12.

Figure 7:
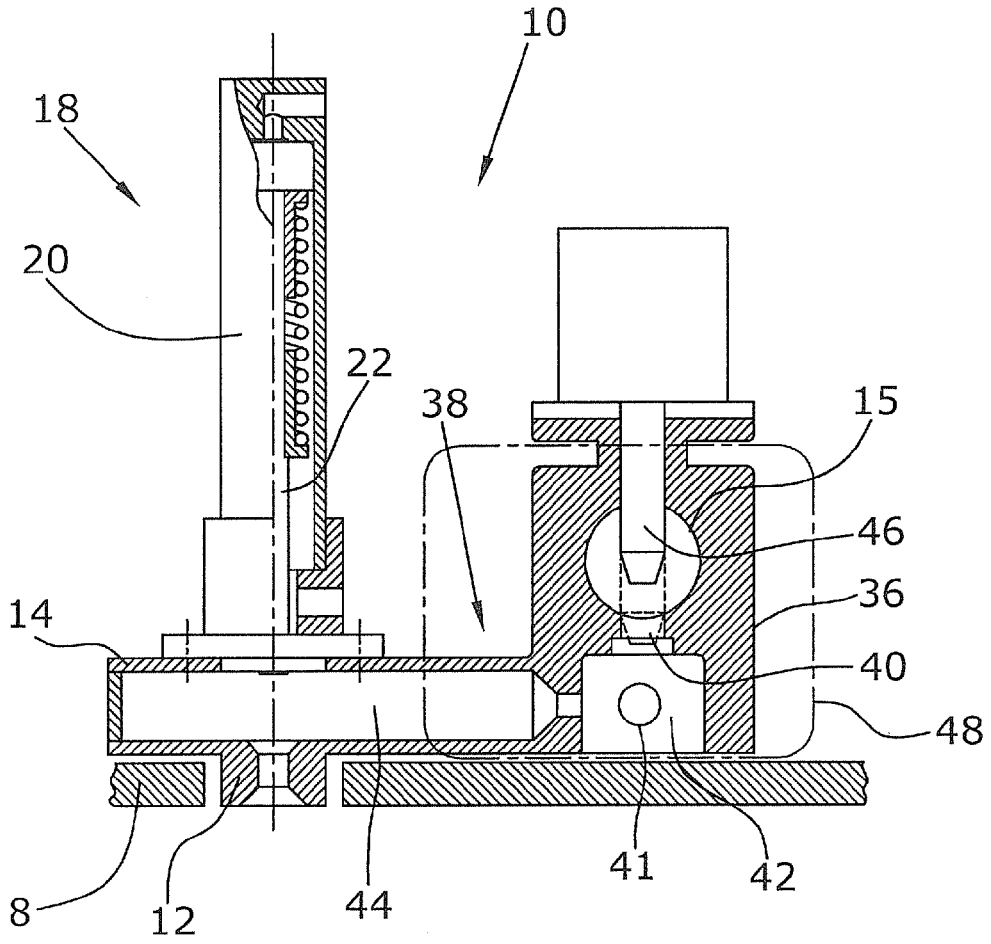
FIG. 7 shows an embodiment of an outlet nozzle for foamed bitumen.

FIG. 7 shows an embodiment of a spraying device 10 for foamed bitumen with a mixing device 36. The mixing device 36 comprises an expansion chamber 38 in which hot bitumen supplied via a bitumen injection nozzle 40 is mixable with water or with water and air for the production of foamed bitumen. The expansion chamber 38 shown in FIG. 7 is comprised of a mixing chamber 42 and an injection chamber 44 connected to the mixing chamber 42, with the outlet nozzle 12 and the related closing mechanism 18 being arranged at the injection chamber 44. The hot bitumen is supplied via a loop conduit 15, with a valve tappet 46 actuated by a drivable driving device being able to close or uncover the nozzle inlet opening of the bitumen injection nozzle 40. Water or water and air can be supplied via one or two connections 41 of the mixing chamber 42.

The mixing device 36 may be surrounded by a heating device 48 which prevents hardening of the bitumen during the working operation. The closing element 22 of the closing mechanism 18 traverses the injection chamber 44 for the purpose of closing or cleaning the outlet nozzle 12.

It is understood that it is also possible to use other driving devices drivable by the controller, such as electric motors, linear drives or similar.

The invention claimed is:

1. An apparatus for working ground surfaces or roadways, comprising:

a machine frame;

a drum housing supported from the machine frame;

a working drum located in the drum housing;

at least one spraying system including at least first and second outlet nozzle assemblies arranged next to one another and directed toward the working drum for spraying agents, each of the first and second outlet nozzle assemblies including:

an outlet nozzle including a nozzle channel, the outlet nozzle including an outer wall including at least one cut-out configured to conduct spraying agent into the outlet nozzle;

a drivable closing mechanism including a closing element movable on a specified path between an open position in which the nozzle channel is fully uncovered, and a closed position in which the closing element closes the nozzle channel; and the outlet nozzle and the closing element being configured such that a flow cross-section between the nozzle channel and the closing element is variable in accordance with a position of the closing element on the specified path; and a controller operably associated with the drivable closing mechanisms and configured to position at least one of the closing elements in at least one intermediate position between the open and closed positions of the at least one closing element.

2. The apparatus of claim 1, wherein:

the closing elements of the first and second outlet nozzle assemblies are positionable by the controller in identical intermediate positions between their open and closed positions.

3. The apparatus of claim 1, wherein:

the closing elements of the first and second outlet nozzle assemblies are positionable by the controller in individually different intermediate positions between their open and closed positions.

4. The apparatus of claim 1, wherein:

the flow cross-section between each nozzle channel and its respective closing element decreases as the closing element moves toward the closed position.

5. The apparatus of claim 1, wherein:

each closing element is movable and positionable coaxially with the nozzle channel of its respective outlet nozzle.

6. The apparatus of claim 1, wherein:

each outlet nozzle includes a variable nozzle geometry such that the flow cross-section between the nozzle channel and its respective closing element decreases as the closing element moves toward the closed position.

7. The apparatus of claim 1, wherein:

each drivable closing mechanism includes a displacement measuring sensor configured to supply a measured displacement signal to the controller; and the controller is configured to send an actuation signal to the drivable closing mechanism to control a current position of the closing element.

8. The apparatus of claim 1, wherein:

the controller is configured to cause an additional movement of each closing element beyond the closed position to enable material accumulations in and/or in front of the outlet nozzle to be removed.

9. The apparatus of claim 1, wherein:

the nozzle channel of each outlet nozzle includes on an inlet side a first section having a conical cross-section narrowing in a direction of flow of the outlet nozzle.

10. The apparatus of claim 1, wherein:

each closing element includes a first section facing the outlet nozzle and a second section on an opposite side of the first section from the outlet nozzle, the first section having a smaller cross-sectional area than the second section, the second section being sized to close the nozzle channel.

11. The apparatus of claim 1, wherein:

each outlet nozzle includes a first section on an inlet side of the outlet nozzle, the first section including the outer wall including the at least one cut-out configured to conduct spraying agent into the outlet nozzle.

12. The apparatus of claim 1, wherein:

each cut-out has a width which changes in a closing direction of the closing element.

13. The apparatus of claim 12, wherein:

the nozzle channel of each outlet nozzle includes a constant cross-section.

14. The apparatus of claim 1, wherein:

the nozzle channel of each outlet nozzle includes a constant cross-section.

15. The apparatus of claim 1, wherein:

the controller is configured to control the flow cross-section of each outlet nozzle assembly in response to at least one parameter selected from the group consisting of:

a currently specified flow rate;

a currently used spraying agent;

a transverse slope of the spraying system; and a pressure in the spraying system.

16. The apparatus of claim 1, wherein:

the spraying system includes a conduit for spraying agents, the conduit including a conduit wall and a conduit interior, and each of the outlet nozzles extends through the conduit wall and communicates with the conduit interior.

17. The apparatus of claim 1, wherein:

each outlet nozzle includes a nozzle inlet and a nozzle outlet and each cut-out tapers toward the nozzle outlet.

18. The apparatus of claim 17, wherein each cut-out is V-shaped.

19. An apparatus for working ground surfaces or roadways, comprising:

a machine frame;

a drum housing supported from the machine frame;

a working drum located in the drum housing;

at least one spraying system including a conduit for spraying agents, the conduit including a conduit wall and a conduit interior, the spraying system further including at least first and second outlet nozzle assemblies arranged next to one another and directed toward the working drum for spraying agents, each of the first and second outlet nozzle assemblies including:

an outlet nozzle including a nozzle channel, the outlet nozzle extending through the conduit wall and communicating with the conduit interior;

a drivable closing mechanism including a closing element movable on a specified path between an open position in which the nozzle channel is fully uncovered, and a closed position in which the closing element closes the nozzle channel; and the outlet nozzle and the closing element being configured such that a flow cross-section between the nozzle channel and the closing element is variable in accordance with a position of the closing element on the specified path; and a controller operably associated with the drivable closing mechanisms and configured to position at least one of the closing elements in at least one intermediate position between the open and closed positions of the at least one closing element.

20. The apparatus of claim 19, wherein:

the closing elements of the first and second outlet nozzle assemblies are positionable by the controller in identical intermediate positions between their open and closed positions.

21. The apparatus of claim 19, wherein:

the closing elements of the first and second outlet nozzle assemblies are positionable by the controller in individually different intermediate positions between their open and closed positions.

22. The apparatus of claim 19, wherein:

the flow cross-section between each nozzle channel and its respective closing element decreases as the closing element moves toward the closed position.

23. The apparatus of claim 19, wherein:

each closing element is movable and positionable coaxially with the nozzle channel of its respective outlet nozzle.

24. The apparatus of claim 19, wherein:

each outlet nozzle includes a variable nozzle geometry such that the flow cross-section between the nozzle channel and its respective closing element decreases as the closing element moves toward the closed position.

25. The apparatus of claim 19, wherein:

each drivable closing mechanism includes a displacement measuring sensor configured to supply a measured displacement signal to the controller; and the controller is configured to send an actuation signal to the drivable closing mechanism to control a current position of the closing element.

26. The apparatus of claim 19, wherein:

the controller is configured to cause an additional movement of each closing element beyond the closed position to enable material accumulations in and/or in front of the outlet nozzle to be removed.

27. The apparatus of claim 19, wherein:

the nozzle channel of each outlet nozzle includes on an inlet side a first section having a conical cross-section narrowing in a direction of flow of the outlet nozzle.

28. The apparatus of claim 19, wherein:

each closing element includes a first section facing the outlet nozzle and a second section on an opposite side of the first section from the outlet nozzle, the first section having a smaller cross-sectional area than the second section, the second section being sized to close the nozzle channel.

29. The apparatus of claim 19, wherein:

each outlet nozzle includes an outer wall including at least one cut-out configured to conduct spraying agent into the outlet nozzle.

30. The apparatus of claim 29, wherein:

each cut-out has a width which changes in a closing direction of the closing element.

31. The apparatus of claim 30, wherein:

the nozzle channel of each outlet nozzle includes a constant cross-section.

32. The apparatus of claim 19, wherein:

the controller is configured to control the flow cross-section of each outlet nozzle assembly in response to at least one parameter selected from the group consisting of:

a currently specified flow rate;

a currently used spraying agent;

a transverse slope of the spraying system; and a pressure in the spraying system.

33. A method of working ground surfaces or roadways with an apparatus including a working drum, at least one spraying system including at least first and second outlet nozzle assemblies for spraying agents arranged next to one another and directed towards the working drum, each nozzle assembly including an outlet nozzle including a nozzle channel and a closing element movable between an open position in which the nozzle channel is uncovered and a closed position in which the nozzle channel is closed, the method comprising:

(a) operating the working drum; and (b) positioning at least one of the closing elements during step (a) in an intermediate position between the open and closed positions to adjust a variable selectable flow cross-section of the nozzle assembly associated with the at least one closing element, wherein each outlet nozzle includes an outer wall including at least one cut-out and the closing element partially blocks the cut-out in the intermediate position.

34. The method of claim 33, wherein:

in step (b) the closing elements of the first and second outlet nozzle assemblies are positioned in identical intermediate positions.

35. The method of claim 33, wherein:

in step (b) the closing elements of the first and second outlet nozzle assemblies are positioned in different intermediate positions.

36. The method of claim 33, wherein:

in step (b) the flow cross-section for each outlet nozzle is controlled in accordance with a currently specified flow rate.

37. The method of claim 33, wherein:

in step (b) the flow cross-section for each outlet nozzle is controlled in accordance with a currently used spraying agent.

38. The method of claim 33, wherein:

in step (b) the flow cross-section for each outlet nozzle is controlled in accordance with a transverse slope of the spraying system.

39. The method of claim 33, wherein:

in step (b) the flow cross-section for each outlet nozzle is controlled in accordance with a pressure in the spraying system.

40. The method of claim 33, wherein the variable selectable flow cross-section of each outlet nozzle assembly is generated by an interaction of a geometry of the outlet nozzle with the position of the closing element.

41. The method of claim 33, wherein:

in step (b) each outlet nozzle includes a nozzle inlet and a nozzle outlet and each cut-out tapers toward the nozzle outlet.

42. The method of claim 41, wherein each cut-out is V-shaped.

* * * * *